US009700899B2

(12) United States Patent
Park et al.

(10) Patent No.: US 9,700,899 B2
(45) Date of Patent: Jul. 11, 2017

(54) RAW MATERIAL SORTING APPARATUS AND METHOD THEREFOR

(71) Applicant: POSCO, Pohang-Si (KR)

(72) Inventors: Chong Lyuck Park, Pohang-si (KR); Young Cheol Yang, Pohang-si (KR); Jung Ah Kim, Bucheon-si (KR); In Kook Suh, Pohang-si (KR); Dong Seok Jang, Pohang-si (KR)

(73) Assignee: POSCO, Pohang-Si (KR)

( * ) Notice: Subject to any disclaimer, the term of this patent is extended or adjusted under 35 U.S.C. 154(b) by 0 days.

(21) Appl. No.: 14/779,414

(22) PCT Filed: Dec. 26, 2013

(86) PCT No.: PCT/KR2013/012161

§ 371 (c)(1),
(2) Date: Sep. 23, 2015

(87) PCT Pub. No.: WO2014/171612

PCT Pub. Date: Oct. 23, 2014

(65) Prior Publication Data

US 2016/0038950 A1 Feb. 11, 2016

(30) Foreign Application Priority Data

Apr. 15, 2013 (KR) ..... 10-2013-0041148
Oct. 11, 2013 (KR) ..... 10-2013-0121142

(51) Int. Cl.
*B03C 7/00* (2006.01)
*B03C 7/12* (2006.01)
*B03C 7/08* (2006.01)

(52) U.S. Cl.
CPC ..... *B03C 7/003* (2013.01); *B03C 7/006* (2013.01); *B03C 7/08* (2013.01); *B03C 7/12* (2013.01)

(58) Field of Classification Search
CPC B03C 7/003; B03C 7/006; B03C 7/08; B03C 7/12
(Continued)

(56) References Cited

U.S. PATENT DOCUMENTS 1,575,165 A * 3/1926 Hopkinson ..... B03C 3/10 209/129
2,174,681 A * 10/1939 Bartlett ..... B03C 7/12 209/127.4
(Continued)

FOREIGN PATENT DOCUMENTS

CN 87103822 12/1988
CN 100475349 4/2009
(Continued)

OTHER PUBLICATIONS

Australian Office Action—Australian Application No. 2013386925 issued on Jan. 7, 2016, JP 4354817.
(Continued)

*Primary Examiner* — Joseph C Rodriguez
(74) *Attorney, Agent, or Firm* — Cantor Colburn LLP

(57) ABSTRACT

An apparatus for separating the main component constituting a raw material from impurities includes: a raw material supply unit for supplying a raw material; a charging unit for charging the raw material supplied from the raw material supply unit; an electrostatic sorting unit for sorting the raw material, which has been charged by the charging unit, according to polarity; and a storage unit for collecting the raw material sorted by and falling from the electrostatic sorting unit, wherein the charging unit includes a charging chamber having a space therein for charging the raw material supplied from the raw material supply unit, and a charging rotor rotatably provided in the charging chamber, for impacting the raw material supplied from the raw material supply unit by the rotating force, thus effectively
(Continued)

separating the impurities such as ash and sulfur contained in a raw material, e.g. coal.

14 Claims, 6 Drawing Sheets

(58) Field of Classification Search
USPC ..... 209/127.2, 127.4
See application file for complete search history.

(56) References Cited

U.S. PATENT DOCUMENTS

| | | | | |
|---|---|---|---|---|
| 2,300,324 | A * | 10/1942 | Thompson | B03C 7/00 15/1.51 |
| 2,479,615 | A * | 8/1949 | Guizzetti | C22B 11/10 209/127.4 |
| 4,092,241 | A * | 5/1978 | Mackenzie | B03C 7/06 209/127.2 |
| 4,557,827 | A * | 12/1985 | Fricke | B03C 7/12 209/127.4 |
| 5,251,762 | A * | 10/1993 | Taylor | B03C 7/12 209/127.4 |
| 5,513,755 | A * | 5/1996 | Heavilon | B03B 9/04 209/11 |
| 5,542,543 | A * | 8/1996 | Yasukuni | B03C 7/006 209/127.1 |
| 5,885,330 | A * | 3/1999 | Lee | B03C 7/006 209/127.1 |
| 6,011,229 | A * | 1/2000 | Geisler | B03C 7/006 209/127.4 |
| 6,168,029 | B1 * | 1/2001 | Henderson | B03C 7/003 209/11 |
| 6,320,148 | B1 | 11/2001 | Yoon et al. | |
| 6,329,623 | B1 * | 12/2001 | Yan | B03C 7/12 209/127.1 |
| 7,431,228 | B2 * | 10/2008 | Bohm | B03C 7/00 241/11 |
| 7,780,101 | B2 * | 8/2010 | Bohm | B03C 7/00 241/79.2 |
| 7,963,398 | B2 * | 6/2011 | Robl | B03B 5/62 209/157 |
| 8,338,734 | B2 * | 12/2012 | Tao | B03C 3/08 204/164 |
| 8,541,709 | B2 * | 9/2013 | Calin | B03C 3/14 209/12.2 |
| 8,853,583 | B2 * | 10/2014 | Cassani | B03C 7/12 209/12.2 |
| 2007/0084758 | A1 * | 4/2007 | Endo | B03C 7/10 209/127.3 |
| 2011/0036758 | A1 | 2/2011 | Kim et al. | |

FOREIGN PATENT DOCUMENTS

| | | |
|---|---|---|
| CN | 202045016 | 11/2011 |
| JP | 58163457 | 9/1983 |
| JP | 05319994 | 12/1993 |
| JP | 07116548 | 5/1995 |
| JP | 09040980 | 2/1997 |
| JP | 09267052 | 10/1997 |
| JP | 1997299829 | 11/1997 |
| JP | 2880932 | 4/1999 |
| JP | 11114451 | 4/1999 |
| JP | 2000061358 | 2/2000 |
| JP | 2000317345 | 11/2000 |
| JP | 2002136894 | 5/2002 |
| JP | 2003001632 | 1/2003 |
| JP | 2005507777 | 3/2005 |
| JP | 4354817 | 10/2009 |
| JP | 2011073408 | 4/2011 |
| JP | 2011115753 | 6/2011 |
| JP | 2011177624 | 9/2011 |
| KR | 1020060052770 | 5/2006 |
| KR | 100926548 | 11/2009 |
| KR | 20100013767 | 2/2010 |
| KR | 100974206 | 8/2010 |
| KR | 1020110016680 | 2/2011 |
| WO | 2012101874 | 8/2012 |

OTHER PUBLICATIONS

International Search Report—PCT/KR2013/012161 dated Apr. 24, 2014.

PCT Written Opinion—PCT/KR2013/012161 issued on Apr. 24, 2014, JP 435817, KR 10-0926548, KR 10-2011-0016680 and KR 10-2010-0013767.

* cited by examiner (a)

(b)

RAW MATERIAL SORTING APPARATUS AND METHOD THEREFOR

TECHNICAL FIELD

The present invention relates to a raw material sorting apparatus and a method therefor, and more particularly, to a raw material sorting apparatus which is capable of effectively sorting impurities such as ash and sulfur contained in a raw material, e.g., coal, and a method therefor.

BACKGROUND ART

In general, coal used in a steel mill is largely classified into coal for manufacturing coke, coal for pulverized coal injection (PCI) into a furnace, and coal for sintering.

In case of the coal for manufacturing the coke, the coal has a property in which the coal changes into a very stiff liquid state when coal is indirectly heated. The powder coal may be manufactured into coke having a lump shape by using the above-described phase change phenomenon. All coal may not have the above-described property, but a portion of coal may have the above-described property. That is, coal having a liquid state such as bitumen may be called bituminous coal. Since the bituminous coal has finite resources, and a ratio of supply to demand is less, the bituminous may be expensive.

Coke together with iron ore may be sequentially inserted through an upper portion of a furnace to generate heat, thereby melting the iron ore. Then, the coke may be disposed in the form of slag through a lower portion of the furnace. Here, a method for supplying heat into the furnace may include a method for putting coke through the upper portion of the furnace and a method for injecting pulverized coal together with hot wind through the lower portion of the furnace. The pulverized coal that is used in the method for injecting the pulverized coal together with the hot wind through the lower portion of the furnace may be called "coal for pulverized coal injection (PCI)". Since the coal for the PCI had to be sufficiently well burnt for a shot time, a pulverized degree of the coal or heat quantity of the coal may be very important. Since a waste gas generated while heat is released is not radiated to the atmosphere, but is collected as a heating source having a gas shape, various kinds of coal may be used.

The coal for sintering may be used for supplying heat to the pulverized coal while the heat is applied to the pulverized coal such as iron ore to generate sintered ore. In the sintering process, the coal for sintering may be directly burnt, and the waste gas generated when the combustion may be discharged to the outside through a chimney. Thus, anthracite coal having a high heat generation rate and low nitrogen content to reduce emission of nitrogen oxide (NOx) may be used as the coal for sintering.

Studies for removing minerals constituting ash and sulfur (S) components from coal are being systematically carried out for a long time. However, development of a dry sorting technology having high sorting efficiency and economic feasibility are treated as problems to be ironed out.

A wet treating process such as specific gravity sorting using spiral, jig, and heavy liquid and flotation sorting using a collecting agent and foaming agent are mainly used for the general coal sorting process. In case of the wet treating process, an incidental process for recycling used water and treating waste water and a dehydrating and drying process for removing moisture of the sorted coal concentration are necessary. Thus, the wet treating process may be complicated, and costs required for the sorting may increase. However, since coal is an inexpensive mineral, it may be necessary to develop a technology in which the coal is dry-treated to economically sort the coal.

Effects that are expected by removing the ash and sulfur from the coal may include an increase in heat generation rate of coal, stabilization in combustion, an increase in thermal efficiency of a power plant due to reduction of coal ash, and improvement in production efficiency of a furnace for manufacturing iron due to reduction of slag. Also, abrasion and corrosion within a boiler and furnace due to the ash and sulfur may decrease to reduce a time that is taken to repair and maintain equipment, thereby improving working efficiency.

Also, since an additionally installing process and operation cost of dust collection equipment or desulfurization facility for removing coal ash and sulfurous acid gas that are generated when the coal is burnt is necessary, a technology for minimizing contents of the ash and sulfur in the coal before the combustion is very important. Also, it is necessary to develop a technology for effectively sorting the ash and sulfur components of the coal to deal with environmental pollution problems that are being enhanced at home and abroad.

DISCLOSURE OF THE INVENTION

Technical Problem

The present invention provides a raw material sorting apparatus that increases charging efficiency of a raw material and reduces a time taken to charge the raw material to improve raw material sorting efficiency and a method therefor.

The present invention provides a raw material sorting apparatus that is capable of easily removing impurities contained in a raw material and a method therefor.

The present invention provides a raw material sorting apparatus that is capable of restricting or preventing environmental pollution and a method therefor.

Technical Solution

In one embodiment, a raw material sorting apparatus for sorting a raw material into a main component constituting the raw material and impurities includes: a raw material supply unit configured to supply the raw material; a charging unit configured to charge the raw material supplied from the raw material supply unit; a electrostatic sorting unit configured to separate the raw material charged in the charging unit according to polarities of the raw material; and a sorting storage unit configured to collect the raw material that is sorted in the electrostatic sorting unit to drop, wherein the charging unit includes: a charging chamber providing a space, in which the raw material supplied from the raw material supply unit is charged, in the charging unit; and a charging rotor rotatably provided in the charging chamber to apply an impact to the raw material supplied from the raw material supply unit by a rotation force thereof.

The charging chamber may include: a charging plate having an inclined surface, which is inclined toward a central axis of the charging chamber, therein; and a heater configured to heat the charging chamber.

The charging rotor may include: a rotation shaft; a driver configured to provide a rotation force to the rotation shaft; a distributor disposed above the rotation shaft; at least one blade disposed below the distributor, the at least one blade being radially connected to an outer circumferential surface of the rotation shaft; and a rotation plate disposed below the blade, the rotation plate being connected to the outer circumferential surface of the rotation shaft.

The distributor may have a cone or polygonal pyramid shape.

An uneven structure may be disposed on surfaces of the blade and the rotation plate.

The electrostatic sorting unit may include: a negative electrode plate that is vertically disposed; and a positive electrode plate vertically disposed to be spaced apart from the negative electrode plate, wherein each of the negative electrode plate and the positive electrode plate may have a power portion that is inclined toward the outside.

At least one of a distance and angle between the negative electrode plate and the positive electrode plate may be adjustable.

The electrostatic sorting unit may include: a pair of electrode members spaced apart from each other, the pair of electrode members being vertically disposed; and a rotation sheet surrounding the electrode member to vertically rotate, wherein the pair of electrode members may have polarities different from each other.

A scraper configured to separate the raw material attached to the rotation sheet may be disposed on one side of the rotation sheet.

The electrostatic sorting unit may include: a lower conveyor including a first belt that operates in a caterpillar manner and a first electrode body disposed in an inner region of the first belt; and an upper conveyor spaced apart upward from the lower conveyor, the upper conveyor including a second belt that operates in the caterpillar manner and a second electrode body having a polarity different from that of the first electrode body and disposed in an inner region of the second belt.

In the lower conveyor, the first belt may be connected to a pair of lower driving shafts to operate in the caterpillar manner, the first electrode body may be disposed between the pair of lower driving shafts, and a first deionizer may be disposed at one side of the inner region of the first belt, and in the upper conveyor, the second belt is connected to a pair of upper driving shafts to operate in the caterpillar manner, the second electrode body is disposed between the pair of upper driving shafts, and a second deionizer is disposed at one side of the inner region of the second belt.

A scraper may be disposed outside at least one of the first and second belts.

Each of the first and second belts may be formed of an electrically conductive material.

The upper conveyor may include a tension shaft that lifts a return part of the second belt upward to maintain tension of the second belt.

The upper conveyor and the lower conveyor may at least partially overlap each other, and surfaces of the upper conveyor and the lower conveyor, which face each other, may be disposed in parallel to each other.

A rotation wall configured to separate the main component from the impurities and guide the main component and the impurities to opened upper ends of the first and second storage parts may be disposed on an upper end of a partition wall, and the rotation wall may be hinge-coupled to an upper end of the partition wall to rotate to an upper region of the first or second storage part.

In another embodiment, a method of sorting a raw material into a main component constituting the raw material and impurities include: preparing the raw material; transferring the raw material into a charging unit to charge the raw material; and allowing the charged raw material to drop between negative and positive electrode plates that are spaced apart from each other, thereby sorting the raw material, wherein, in the charging of the raw material, the raw material collides with a rotating charging rotor and is primarily charged, and the raw material scattered by colliding with the charging rotor collides with an inner wall of a charging chamber that is disposed to surround the charging rotor and is secondarily charged.

The charging of the raw material may include heating the charging unit for charging the raw material.

The raw material may include coal, the main component may include carbon, and the impurities may include at least one of ash and sulfur.

Advantageous Effects

In the raw material sorting apparatus and method according to the embodiment of the present invention, the impurities contained in the raw material may be easily reduced. The main component and impurities may be sorted by using a difference in electrostatic polarities of the components contained in the raw material to improve the purity of the raw material that is used in the sorting process. Thus, the inexpensive and low quality raw material in which a large amount of impurities is contained may be utilized to reduce the manufacturing costs.

Also, since the raw material is effectively charged in a relatively small space, the whole size of the equipment may be reduced. Also, when the conveyor type electrostatic sorting unit is used, a large amount of raw materials may be continuously sorted to improve the process efficiency and productivity.

MODE FOR CARRYING OUT THE INVENTION

Hereinafter, an embodiment of the present invention will be described in detail with reference to the accompanying drawings. The present invention may, however, be embodied in different forms and should not be construed as limited to the embodiments set forth herein. Rather, these embodiments are provided so that the present invention will be thorough and complete, and will fully convey the scope of the present invention to those skilled in the art.

The present invention relates to a sorting apparatus for sorting impurities contained in a raw material. The sorting apparatus may be used for sorting a main component constituting the raw material and impurities by using a difference in electrostatic polarities of the main component and the impurities. Hereinafter, a raw material sorting apparatus for sorting carbon particles that are main components constituting coal and sulfur and ash particles that are impurities from the coal that is used in an iron manufacturing factory will be described as an example.

Figure 1:
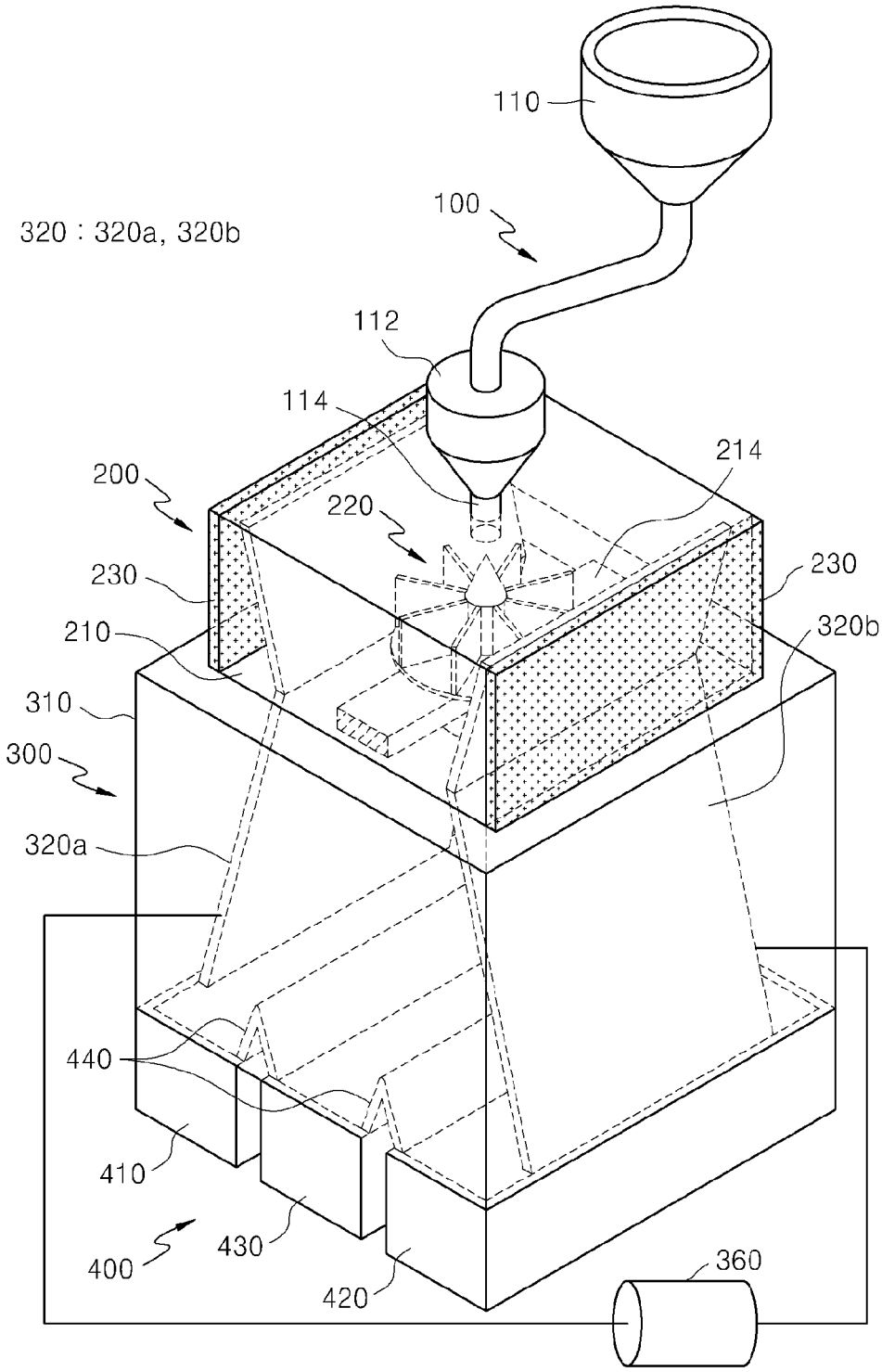
FIG. 1 is a perspective view of a raw material sorting apparatus according to an embodiment of the present invention.
Figure 2:
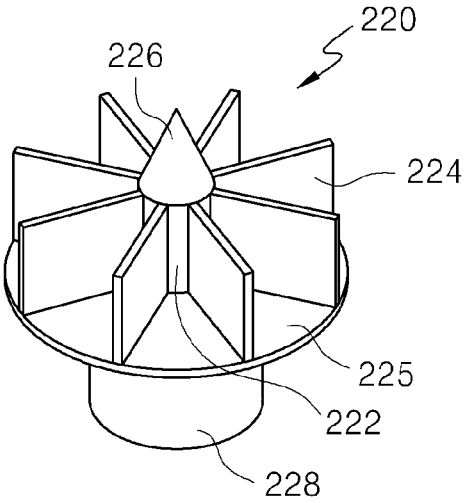
FIG. 2 is a cross-sectional view illustrating a schematic structure of the raw material sorting apparatus according to an embodiment of the present invention.
Figure 2:
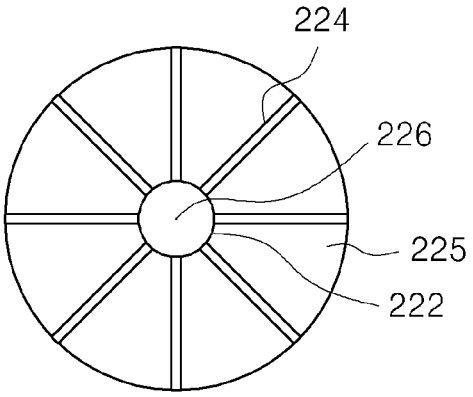
Figure 3:
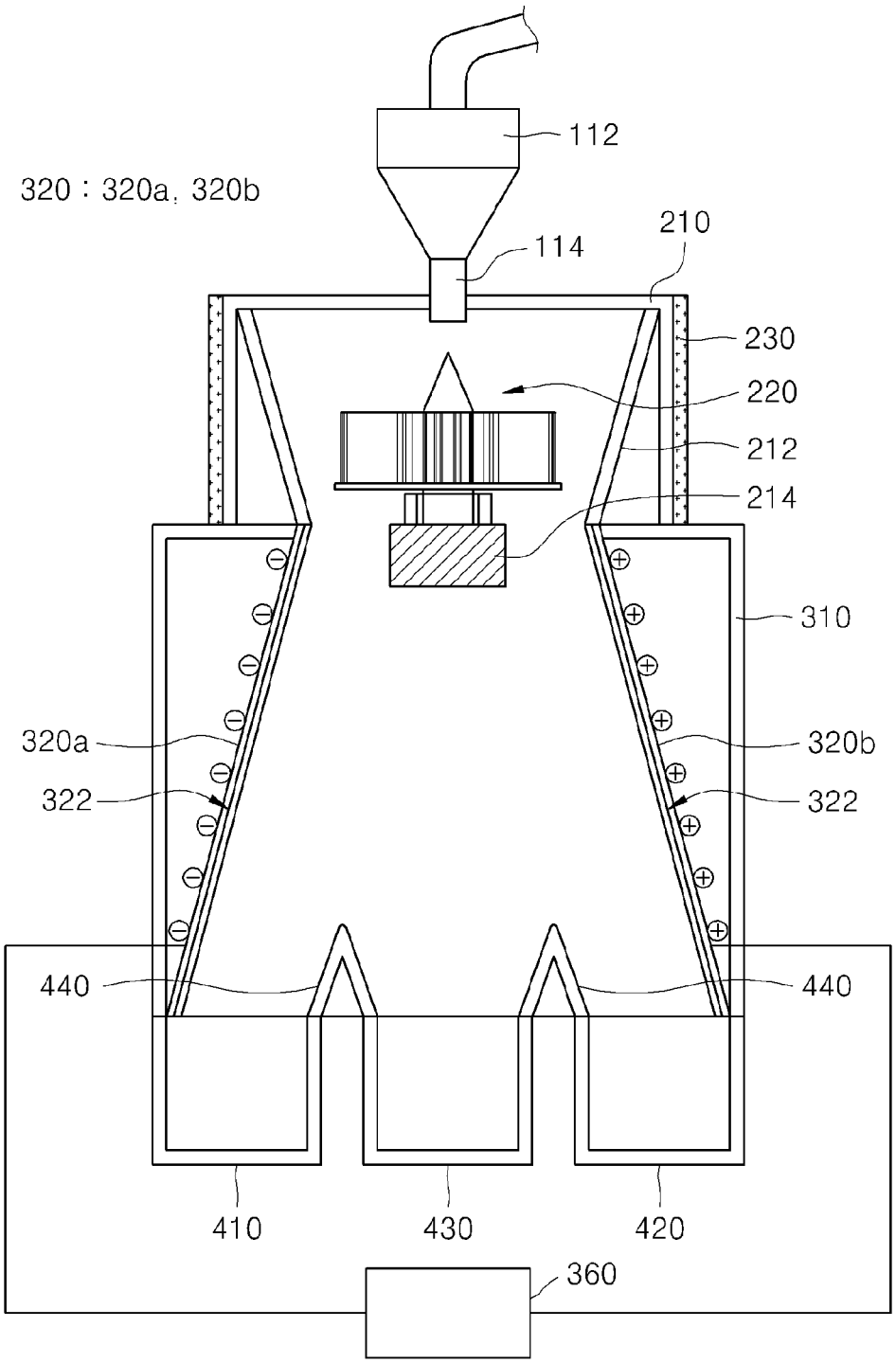
FIG. 3 is a view illustrating a structure of a charging unit illustrated in FIG. 2.
Figure 4:
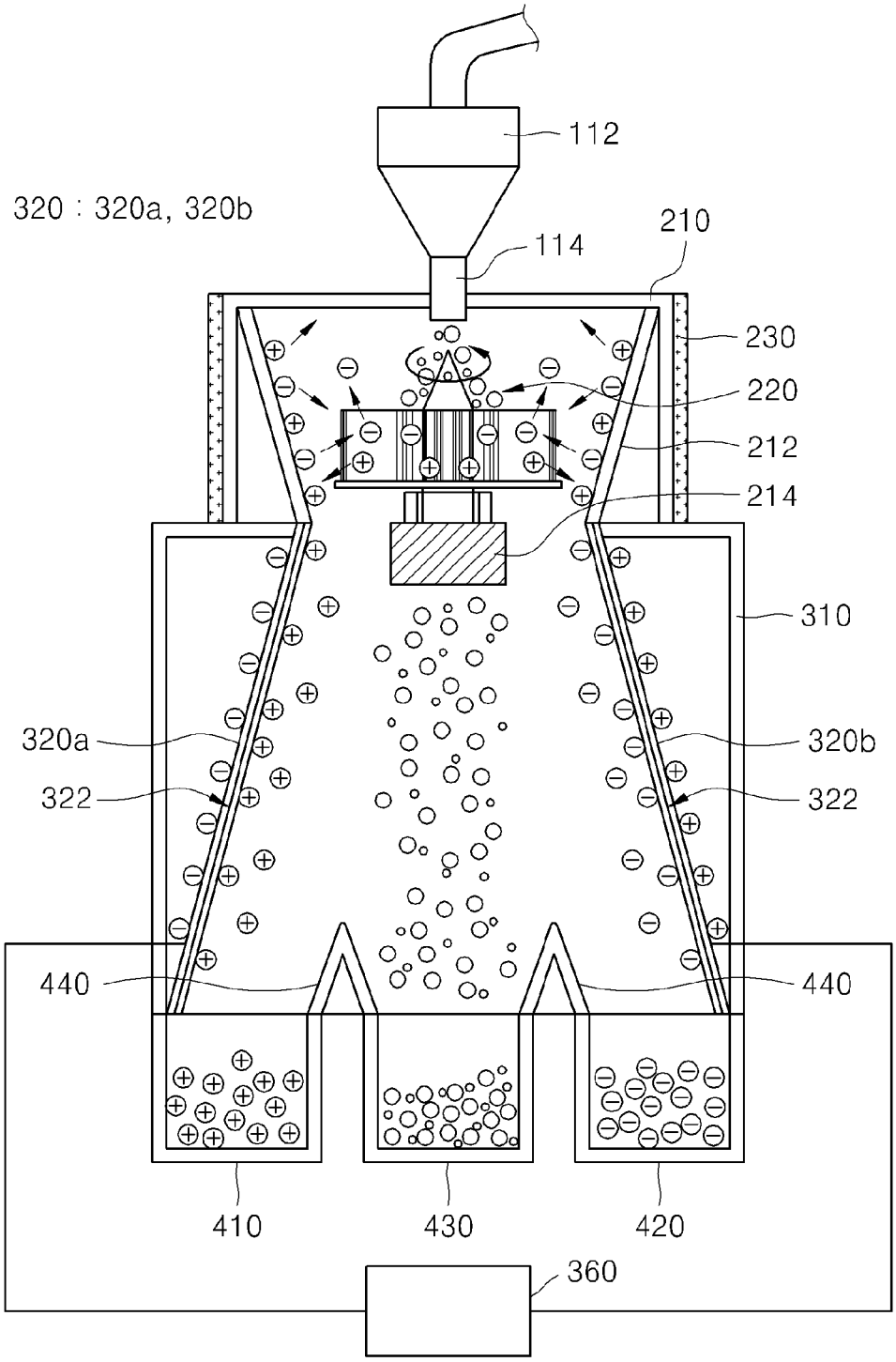
FIG. 4 is a view illustrating a use state of the raw material sorting apparatus according to an embodiment of the present invention.

FIG. 1 is a perspective view of a raw material sorting apparatus according to an embodiment of the present invention, FIG. 2 is a cross-sectional view illustrating a schematic structure of the raw material sorting apparatus according to an embodiment of the present invention, and FIG. 3 is a view illustrating a structure of a charging unit illustrated in FIG. 2. FIG. 4 is a view illustrating a use state of the raw material sorting apparatus according to an embodiment of the present invention.

A raw material sorting apparatus includes a raw material supply unit 100 for supplying a raw material, a charging unit 200 for charging the raw material supplied from the raw material supply unit 100, an electrostatic sorting unit 300 for separating the raw material that is charged in the charging unit 200 according to a polarity of the charged raw material, and a sorting storage unit 400 for collecting the raw material that drops from the electrostatic sorting unit 300.

For example, the raw material supply unit 100 includes a raw material storage unit 110 for storing coal and a hopper 112 for moving the raw material discharged from the raw material 110.

The raw material storage unit 110 stores the raw material that is pulverized to a predetermined size, for example, the coal and discharges the raw material that is fed from the raw material storage unit 110 by a predetermined amount.

The hopper 112 injects the raw material fed from the raw material storage unit 110 into the charging unit 200, and a supply tube 114 through which the raw material moves is disposed on a lower end of the hopper 112 to extend into the charging unit 200. The hopper 112 may have an inclined surface so that the raw material fed from the raw material storage unit 110 is smoothly discharged into the charging unit 200. Also, the hopper 112 may have an uneven structure having a cyclone shape on an inner wall so that the raw material is uniformly discharged at a predetermined rate into the charging unit 200.

The charging unit 200 may include a charging chamber 210 and a charging rotor 220 disposed in the charging chamber 210.

The charging chamber 210 provides a space, in which the raw material discharged from the raw material supply unit 100 is charged, therein. A charging plate 212 having an inclined surface, that gradually narrows the space downwards, to prevent the raw material discharged from the raw material supply unit 100 from directly falling into the electrostatic sorting unit 300 is disposed in the charging chamber 210. As described above, the charging plate 212 may be integrated with the charging chamber or separately provided in the charging chamber 210. The charging plate 212 may collide with the charging rotor 220 so that the charged raw material or the raw material that is not charged collides with or is rubbed with a surface of the charging plate 212 and thus is charged while being scattered by a rotation force of the charging rotor 220. Thus, the charging plate 212 may be formed of a material that is capable of charging the raw material, for example, the carbon particles, the ash particles, the sulfur particles, and the like or may be provided as a coating material on the surface of the charging plate 212. The above-described material may include copper, Teflon, and the like.

Here, a heater 230 may be disposed on the charging chamber 210 to improve charging efficiency of the coal particles. The heater 230 may include an induction coil or surface heater. The heater 230 may surround the outside of the charging chamber 210 to uniformly heat the charging chamber 210. The charging chamber 210 may be heated at a temperature of about 200° C. or less by using the heater 230 to improve the charging efficiency of the coal particles such as carbon, sulfur, and ash.

The charging rotor 220 is disposed on a center of a lower portion of the charging chamber 210 to apply an impact to the raw material supplied from the raw material supply unit 100, thereby charging the raw material so that the carbon and ash particles of the raw material have negative charges (−) and positive charges (+).

The charging rotor 220 includes a rotation shaft 222, a plurality of blades 224 disposed on the rotation shaft 222 and radially disposed about the rotation shaft 222, a rotation plate 225 disposed on a lower portion of the blades 224 and connected to the rotation shaft 222, a distributor 226 disposed on an upper portion of the rotation shaft 222, and a driver 228 providing a rotation force to the rotation shaft 222. The charging rotor 220 may be fixedly disposed on a support 214 that is fixed disposed to cross the charging chamber 210. For example, the driver 228 of the charging rotor 220 may be fixed to the support 214 and thus disposed within the charging chamber 210. Alternatively, the charging rotor 220 may be disposed within the charging chamber 210 through various methods according to structures of the charging chamber 210 and the charging rotor 220.

The rotation shaft 222 is vertically disposed with respect to a central portion of the lower portion of the charging chamber 210 to rotate by the rotation force that is applied from the driver 228.

The blades 224 may be radially connected to an outer circumferential surface of the rotation shaft 222 to rotate together with the rotation shaft 222. The blade 224 may be a unit that applies an impact to the raw material discharged from the raw material supply unit 100 to substantially charge the raw material. Thus, each of the blades 224 may have a wide contact area so as to smoothly charge the raw material. Thus, the blade 224 may have a shape in which the plate having a predetermined area is vertically disposed. As necessary, the blade 224 may be connected in a direction that is perpendicular to a longitudinal direction of the rotation shaft 222 or may be inclinedly connected to the rotation shaft 222. Also, an uneven structure may be provided on a surface of the blade 224 to increase a contact area with the raw material particles.

The rotation plate 225 may be disposed on a lower portion of the blade 224. The rotation plate 225 may prevent the raw material discharged from the raw material supply unit 100 from being directly discharged into the electrostatic sorting unit 300 disposed below the charging unit 200. Also, like the blade 224, the rotation plate 225 may also charge the raw material. Thus, like the blade 224, the rotation plate 225 may also be formed of copper or Teflon which is capable of charging the raw material. Also, an uneven structure for increasing the contact area with the raw material particles may be disposed on a surface of the rotation plate 225.

The distributor 226 may be disposed on the upper portion of the rotation shaft 222 and have a cone or polygonal pyramid shape. The distributor 226 may be disposed directly below the supply tube 114 of the hopper 112 through which the raw material is discharged. The distributor 226 may uniformly distribute the raw material discharged through the supply tube 114 into a space defined between the blades 224.

That is, when the raw material discharged from the supply tube 114 is concentrated into a space defined between specific blades, the collision between the raw material particles and the blades 224 may be limited to deteriorate the charging efficiency of the raw material particles. Thus, the distributor 226 may be disposed on the lower portion of the supply tube 114 through which the raw material is discharged to smoothly supply the raw material into the space defined between the blades 224. Here, when the distributor 226 has the polypyramid shape, the polypyramid shape may have surfaces that has the same number as that of spaces defined between the blades 224. For example, if eight blades 225 are provided, since eight spaces are defined between the blades 225, the distributor 226 may have an octagonal cone shape.

Thus, the collision between the coal particles, collision between the coal particles and the charging materials, and collision and friction between the coal particles and the charging material may occur by the rotation force of the charging rotor 220 while the coal particles are supplied into the charging rotor 220 to generate the negative charges (−) and the positive charges (+). Here, a carbon C component that is a main component of the coal particles may be charged with the positive charges, and the ash particles may be charged with the negative charges. According to a principle that the coal particles are charged, when the particles collide with or is rubbed with other particles or charging material, electrons may move in a direction in which Fermi levels of the two materials are the same by a difference in work function. As a result, while the particles are separated from each other after the collision or friction, excess or lack of the electrons may occur, and thus, the particles may have the positive charges (+) or negative charges (−).

Also, one portion of the coal particles that are charged in the charging rotor 220 and the coal particles that are not charged may be scattered to the surrounding of the charging rotor 220 by the rotation force of the charging rotor 220 to collide with the charging plate 212 within the charging chamber 210, and the other portion of the coal particles may be discharged to the outside of the charging chamber 210, i.e., the electrostatic sorting unit 300. Also, the coal particles scattered to the surrounding of the charging rotor 220 may repeatedly collide and be repeatedly scattered between the charging plate 212 and the charging rotor 220 to further improve the charged degree of the coal particles charged by the charging rotor 220 and charge the coal particles that are not charged, thereby improving the whole charging efficiency. As a result, the charging efficiency of the coal particles in a relatively short path may be improved, and thus, the whole structure and size of the equipment may be reduced.

The coal particles passing through the charging unit 200 may be discharged into the electrostatic sorting unit 300 that is disposed below the charging unit 200.

The electrostatic sorting unit 300 includes a sorting chamber 310, electrode plates 320*a* and 320*b* that are disposed to be spaced apart from each other within the sorting chamber 310, and a power supply 360 for supplying power into the electrode plates 320*a* and 320*b*.

The sorting chamber 310 may prevent dust that generated while the coal particles charged in the charging unit 200 drop and are sorted from occurring. Also, the sorting chamber 310 may provide the space in which the charged coal particles are sorted.

The electrode plates 320*a* and 320*b* may include a negative electrode plate 320*a* for separating the carbon particles having the positive charges and a positive electrode plate 320*b* for separating the sulfur particles and ash which have the negative charges. An electrode member 322 having a predetermined area may be disposed on the inside or one side of each of the negative electrode plate 320*a* and the positive electrode 320*b*. Here, the electrode member 322 may be arranged in various shapes such as a lattice shape. The negative electrode plate 320*a* and the positive electrode plate 320*b* may be spaced apart from each other to face each other. For example, the negative electrode plate 320*a* and the positive electrode plate 320*b* may be disposed so that the spaced distance therebetween increases to the outside of the sorting chamber 310. That is, each of the negative electrode plate 320*a* and the positive electrode plate 320*b* may be inclinedly disposed to have an inclined surface. The negative electrode plate 320*a* and the positive electrode plate 320*b* may be disposed at an angle of about 20 degrees to about 60 degrees therebetween. An angle adjusting unit (not shown) for adjusting an angle of between the negative electrode plate 320*a* and the positive electrode plate 320*b* may be disposed on an upper portion (or lower portion) of each of the negative electrode plate 320*a* and the positive electrode plate 320*b* to adjust an angle between the negative electrode plate 320*a* and the positive electrode plate 320*b* within the proposed range according to the amount of coal particles discharged from the charging unit 200 or the sorting efficiency of the coal particles. For example, if an amount of coal particles that drop between the negative electrode plate 320*a* and the positive electrode plate 320*b* is large, an angle between the negative electrode plate 320*a* and the positive electrode plate 320*b* may increase. Alternatively, an angle between the negative electrode plate 320*a* and the positive electrode plate 320*b* may decrease to increase the sorting efficiency.

Also, although not shown, a vibration member may be disposed on each of the negative electrode plate 320*a* and the positive electrode plate 320*b* to allow the raw material that is attached to the negative electrode plate 320*a* and the positive electrode plate 320*b* and then is sorted to drop down, thereby discharging the sorted raw material into the sorting storage unit 400. Here, the vibration member may intermittently or periodically operate to separate the raw material that is attached to the negative electrode plate 320*a* and the positive electrode plate 320*b*, thereby improving the sorting efficiency.

The power supply 360 supplies power into the electrode member 322.

The coal particles charged through the above-described components may drop between the electrode plates 320*a* and 320*b*, i.e., the negative electrode plate 320*a* and the positive electrode plate 320*b* to allow the carbon particles having the positive charges and the sulfur particles and ash which have the negative charges to move toward the electrode plates 320*a* and 320*b* having polarities opposite to each other, thereby sorting the coal particles.

The sorting storage unit 400 for storing the coal particles that are sorted by the electrode plates 320*a* and 320*b* is disposed below the electrostatic sorting unit 300. The sorting storage unit 400 includes a first storage part 410 disposed below the negative electrode plate 320*a* to store the carbon particles having the positive charges and a second storage part 420 disposed below the positive electrode plate 320*b* to store the sulfur particles and ash particles which have the negative charges. Also, the sorting storage unit 400 may include a third storage part 430 disposed between the first storage part 410 and the second storage part 420 to store a middling that is not charged in the charging unit 200 or the particles that are not sorted by the electrode plates 320*a* and

320*b*. The particles stored in the third storage part 430 may be transferred into the raw material storage unit 110 by using a collection unit (not shown) such as a transfer tube, a conveyor belt, and the like to resort the particles by passing through the charging unit 200 and the electrostatic sorting unit 300.

Also, a separation plate 440 for preventing the particles sorted in the electrostatic sorting unit 300 from being mixed with each other may be disposed between the storage units 410, 420, and 430.

Hereinafter, a raw material sorting apparatus according to a modified example of the prevent invention will be described.

Figure 5:
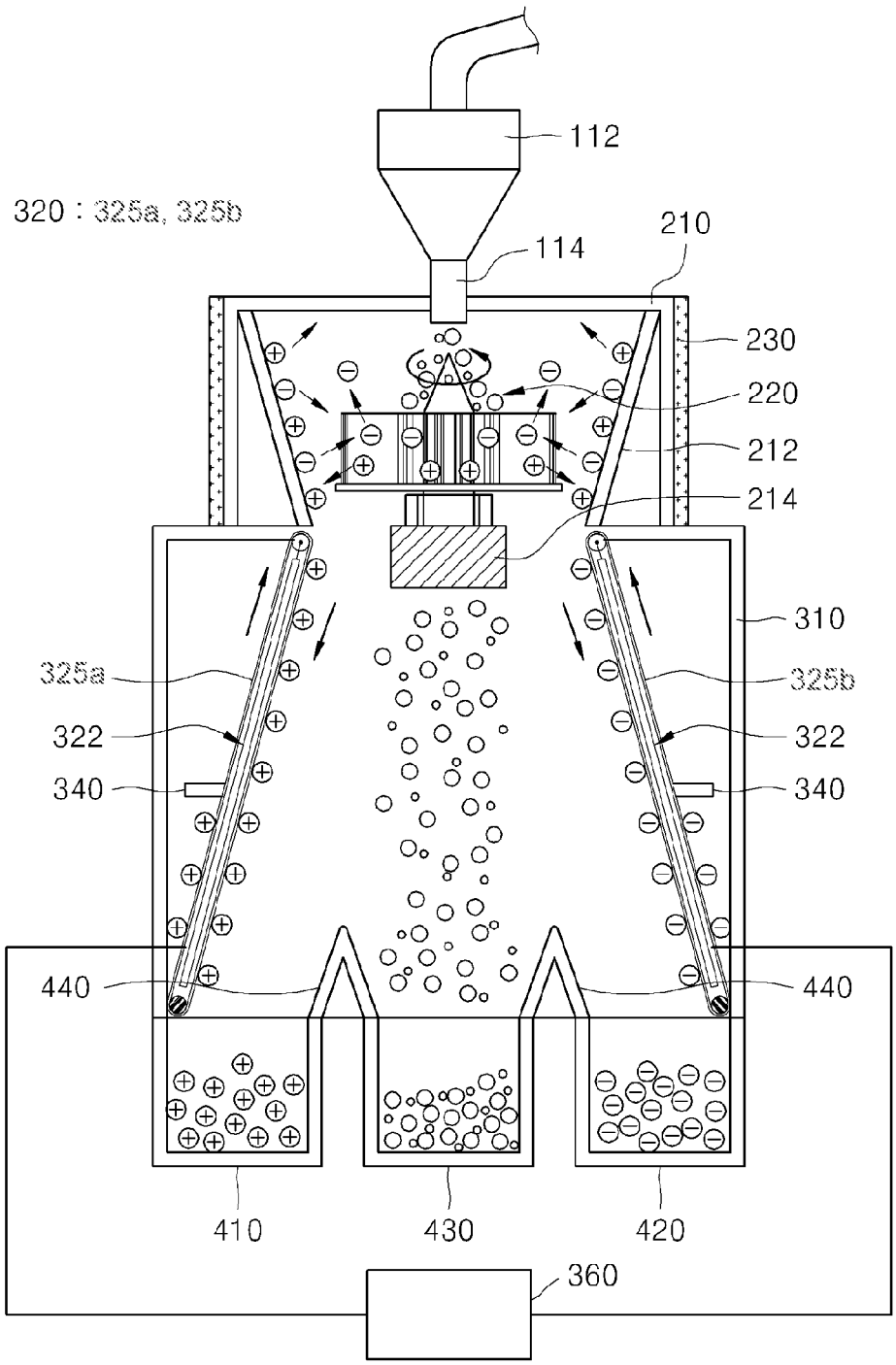
FIG. 5 is a view illustrating a use state of a raw material sorting apparatus according to a modified embodiment of the present invention.

FIG. 5 is a view illustrating a use state of a raw material sorting apparatus according to a modified embodiment of the present invention.

Referring to FIG. 5, a raw material sorting apparatus according to a modified embodiment of the present invention is different from the above-described raw material sorting apparatus in structure of an electrostatic sorting unit.

Referring to FIG. 5, the electrostatic sorting unit according to the modified embodiment includes rotation sheets 325*a* and 325*b* that surround the electrode plates 320*a* and 320*b* and the electrode member 322, which are illustrated in FIGS. 3 and 4, to rotate in a vertical direction. That is, the electrostatic sorting unit includes a pair of electrode members 322 having polarities different from each other and disposed in a vertical direction and the rotation sheets 325*a* and 325*b* that surround the electrode member 322 to rotate in the vertical direction. The rotation sheets 325*a* and 325*b* have polarities different from each other. The rotation sheets 325*a* and 325*b* may be connected to a driving unit (now shown) such as a pulley or motor to rotate along a surface of the electrode member 322, thereby efficiently sorting coal particles that are charged in a charging unit 200. That is, when the charged coal particles are attached to the surfaces of the electrode plates 320*a* and 320*b*, the coal particles attached to the electrode plates 320*a* and 320*b* may interrupt the sorting of the charged coal particles that are continuously disposed from the charging unit 200. Thus, the electrode plates 320*a* and 320*b* may be replaced with the rotation sheets 325*a* and 325*b* to retreat the portion to which the coal particles are attached and expose a sorting area to which the coal particle are not attached, i.e., an area through which the coal particles charged in the charging unit 200 are discharged, thereby effectively sorting the coal particles. The rotation sheets 325*a* and 325*b* may be formed of a synthetic resin such as polyethylene (PE), polypropylene (PP), polyvinyl chloride (PVC), polyvinylidene chloride (PVDC), polyimide (PI), and polyethyleneterephthalate (PET). Each of the rotation sheets 325*a* and 325*b* may have a thickness that is enough to allow electric fields generated in the electrode member 322 to pass therethrough.

A scraper 340 may be disposed on one side, preferably, the outside of each of the rotation sheets 325*a* and 325*b*. The scraper 340 may be disposed to contact a surface of each of the rotation sheets 325*a* and 325*b*, preferably, to contact the surface of each of the rotation sheets 325*a* and 325*b* along a width direction of each of the rotation sheets 325*a* and 325*b*, thereby separating the particles attached to the rotation sheets 325*a* and 325*b* from the rotation sheets 325*a* and 325*b*. Here, since each of the rotation sheets 325*a* and 325*b* has an adjustable angle, the scraper 340 may be movable in a left/right direction according to the angle of each of the rotation sheets 325*a* and 325*b*.

Figure 6:
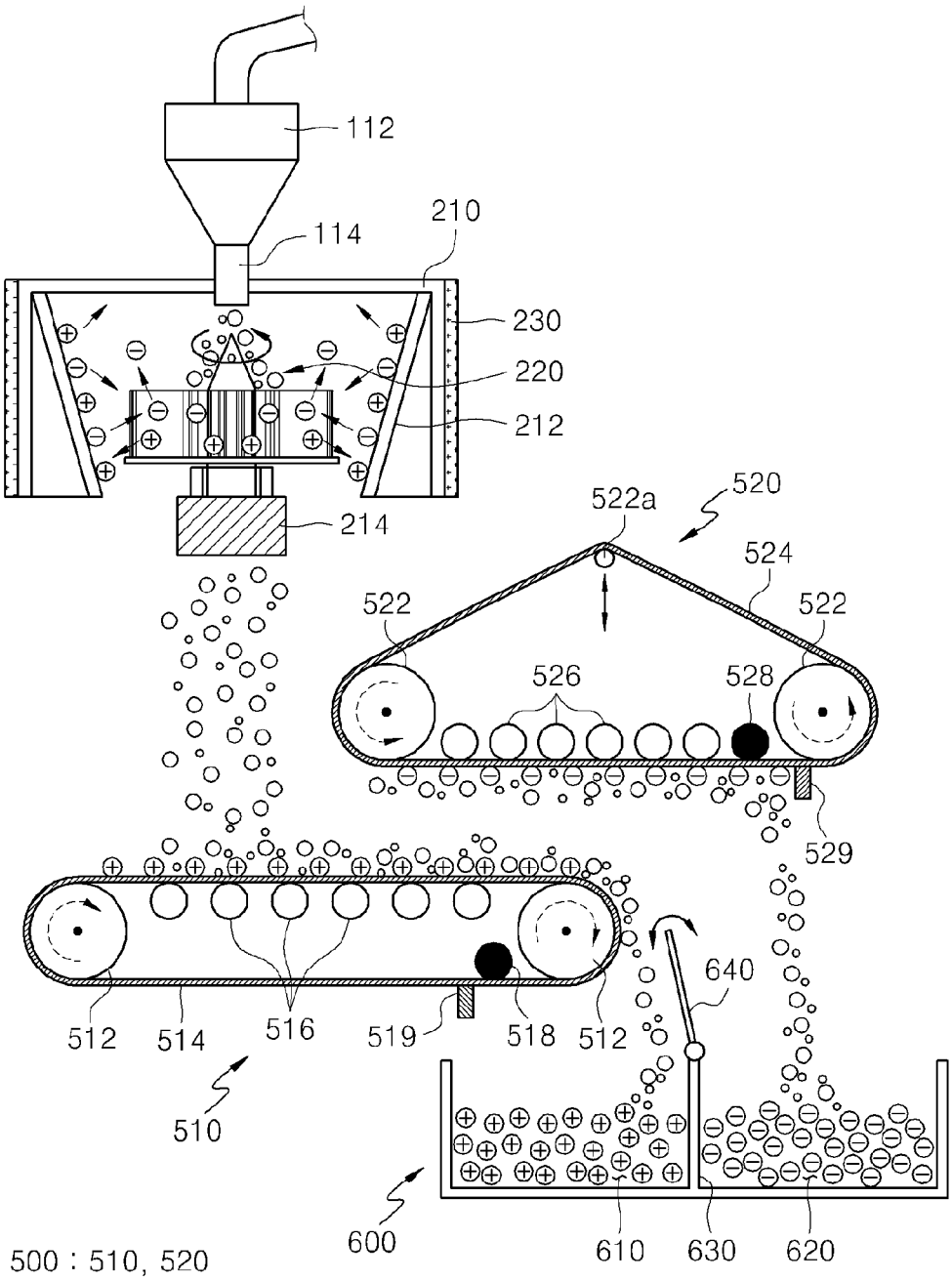
FIG. 6 is a view illustrating a use state of a raw material sorting apparatus according to another modified embodiment of the present invention.

FIG. 6 is a view illustrating a use state of a raw material sorting device according to another modified embodiment of the present invention.

Referring to FIG. 6, a raw material sorting apparatus according to another modified embodiment is different from the above-described raw material sorting apparatus illustrated in FIG. 5 in structure and position of an electrostatic sorting unit and a sorting storage unit.

An electrostatic sorting unit 500 may be realized with a double conveyor type that is vertically disposed. The electrostatic sorting unit 500 may be a unit for electrostatic sorting carbon and fine particles which are charged in the charging unit 200 to have polarities different from each other while being transferred between the conveyors. Thus, the electrostatic sorting unit 500 may include a lower conveyor 510 and an upper conveyor 520. Here, all of the lower and upper conveyors 510 and 520 may operate in a caterpillar manner.

The lower conveyor 510 may be a unit for sorting carbon particles that are charged with positive charges in the charging unit 200. The lower conveyor 510 is disposed below the charging unit 200 from which the raw material that is charged with positive charges and negative charges is discharged. In the lower conveyor 510, a first belt 514 is connected to a pair of lower driving shafts 512 to operate in the caterpillar manner, and a first electrode body 516 to which a negative (−) polarity is added is disposed between the pair of lower driving shafts 512. Also, a first deionizer 518 is disposed on a front region of an inner region of the first belt 514 in a direction in which the carbon particles are transferred. Here, a transfer path for the carbon particles is defined on an upper portion of the first belt 514, and a return part is disposed on a lower portion of the first belt 514. Also, the first electrode body 516 may be disposed adjacent to the transfer path of the first belt 514 in the inner region of the first belt 514, and the first deionizer 518 may be disposed on one side of the first belt 514 that changes in moving direction within the first belt 514. Here, the first deionizer may be disposed on a lower portion of the one side of the first belt 514, on which the return part is disposed, to smoothly sort the carbon particles. As a result, the carbon particles of the raw material discharged from the charging unit 200 may be transferred in a state where the carbon particles are attached to the transfer path of the first belt 514 and then be released in the charged state while passing through the first deionizer 518 and thus separated from the first belt 514 and discharged into a sorting storage unit 600.

The upper conveyor 520 may be a unit for sorting sulfur particles and ash particles which are charged in the charging unit 200. The upper conveyor 520 may be disposed to be spaced upward from the lower conveyor 510. In the upper conveyor 520, a second belt 524 is connected to a pair of upper driving shafts 522 to operate in the caterpillar manner like the lower conveyor 510, and a second electrode body 526 to which a negative (−) polarity is added is disposed between the pair of upper driving shafts 522 in an inner space of the second belt 524. Also, a second deionizer 528 is disposed on a front region of an inner region of the second belt 524 in a direction in which the sulfur particles and ash particles are transferred. Thus, the second electrode body 526 and the second deionizer 528 may be successively disposed in the direction in which the raw material is transferred. Here, a transfer path for the sulfur particles and ash particles is defined on a lower portion of the second belt 524, i.e., a surface facing the first belt 514, and a return part is disposed on an upper portion of the second belt 524. Also, the second electrode body 526 may be disposed adjacent to the transfer path of the second belt 524 in the inner region of the second belt 524, and the second deionizer 528 may be disposed on one side of the second belt 524 that changes in moving direction within the second belt 524. Here, the second deionizer may be disposed on an end of the transfer path, i.e., a portion of the transfer path before the return part starts to smoothly sort the sulfur particles and ash particles. As a result, the sulfur particles and ash particles, which are charged with the negative charges in the charging unit 200, of the raw material discharged into the lower conveyor 510 may be transferred along the transfer path of the first belt 514 and then be transferred into and attached to the transfer path of the second belt 524 that is charged with the positive charges and be released in the charged state while passing through the second deionizer 528 and thus separated from the second belt 524 and discharged into the sorting storage unit 600. Here, a tension shaft 522*a* may be disposed in the inner region of the second belt 524 to prevent the second belt 524, particularly, the transfer path of the second belt 524 from being drooped down by a self-weight. Thus, the return part of the second belt 524 may be lifted upward to maintain tension of the second belt 524.

Also, scrapers 519 and 529 may be respectively disposed outside the first and second belts 514 and 524 to separate the raw material that is not discharged into the sorting storage unit 600, but remains on the first and second belts 514 and 524, thereby discharging the raw material into the sorting storage unit 600. Here, the scrapers 519 and 529 may be disposed at a front side in a rotation direction of the first and second belts 513 and 524 to effectively separate and remove the raw material that remains on the first and second belts 514 and 524.

Also, it is preferable that each of the first and second belts 514 and 524 is formed of an electrically conductive material so that the first and second belts 514 and 524 are charged to corresponding polarities due to the added polarities of the first and second electrode bodies 516 and 526.

A high voltage of about 1 KV to about 60 KV may be applied to each of the first and second electrode bodies 516 and 526. Each of the first and second electrode bodies 516 and 526 may have various shapes such as a wire mesh shape, a rod shape, a plate shape, and the like. However, it is preferable that each of the first and second electrode bodies 516 and 526 has the wire mesh shape to improve sorting efficiency. Also, each of the first and second electrode bodies 516 and 526 may be provided with one or more electrode bodies.

The first and second deionizers 518 and 528 may be respectively disposed on ends of the first and second belts 514 and 524 to neutralize surfaces of the carbon particles, the sulfur particles, and the ash particles which are charged with the corresponding polarities, thereby removing the polarities of the particles. Thus, the carbon particles, the sulfur particles, and the ash particles, which are charged, may be transferred in the state where the particles are attached to the first and second belts 514 and 524 having polarities different from each other, and then, the surfaces of the particles may be neutralized in the vicinity of the first and second deionizers 518 and 528 to remove the attaching force of the first and second belts 514 and 524.

Thus, each of the first and second deionizers 518 and 528 may variously change in position according to arrangements of the lower and upper conveyors 510 and 520 and a position of the sorting storage unit 600 that will be described below.

The arrangement of the lower and upper conveyors 510 and 520 may variously change according to a contact ratio and mineralogical characteristics of the carbon, sulfur, and ash particles. For example, the lower and upper conveyors 510 and 520 may be arranged in a parallel type, inclined type, or cross belt type.

In the modified embodiment, the lower and upper conveyors are disposed in parallel to each other in the parallel type as illustrated in FIG. 6. Here, a region into which the raw material is supplied from the lower conveyor 510 may be disposed without overlapping the upper conveyor 520 to smoothly supply the raw material from the charging unit 200 into the lower conveyor 510.

Also, a front region of the upper conveyor 520 in the transfer direction of the raw material on the upper conveyor 520 from which the raw material is discharged to the sorting storage unit 600, i.e., an end of the upper conveyor 520 may be disposed without overlapping an end of the lower conveyor 510 so that the sorted fine particles drop into the sorting storage unit 600 that will be described below.

The sorting storage unit 600 may be a unit that is disposed below the front region of the electrostatic sorting unit 500 and be attached to the lower and upper conveyors 510 and 520 to separately store the sorted carbon, sulfur, and ash particles. The inside of the sorting storage unit 600 is partitioned into a first storage part 610 in which the carbon particles are stored and a second storage part 620 in which the sulfur and ash particles are stored by a partition wall 630.

The first storage part 610 and the second storage part 620 are opened upward to store the carbon particles and the sulfur and ash particles which drop from the lower and upper conveyors 510 and 520, respectively. Thus, the first storage part 610 may be disposed below the front region of the lower conveyor 510, and the second storage part 620 may be disposed below the front region of the upper conveyor 520. Here, a rotation wall 640 for separating the carbon particles and the sulfur and ash particles to guide the opened upper ends of the first and second storage parts 610 and 620 is disposed on an upper end of the partition wall 630. The rotation wall 640 may be hinge-coupled to the upper end of the partition wall 630 to rotate to the upper region of the first or second storage part 610 or 620.

Hereinafter, a method for sorting a raw material by using the raw material sorting apparatus of the present invention will be described. Here, a method for sorting carbon particles that are main components of coal and sulfur and ash which are impurity components by using the coal as a raw material will be described.

When a process of sorting the raw material starts, a charging rotor 220 of a charging unit 200 and a power supply 360 of an electrostatic sorting unit 300 operate. In addition, power may be supplied into a heater 230 for which the power supply is required to preheat a charging chamber 210 at a predetermined temperature, for example, a temperature of about 200° C.

The coal provided in the raw material storage unit 110 is fed by a predetermined amount into a charging unit 200 through a hopper 112 and a supply tube 114. Here, the coal provided in the raw material storage unit 110 may be pulverized to a predetermined size to easily sort the coal.

The raw material is discharged to an upper portion of a charging rotor 220 within the charging chamber 210. Here, the raw material is uniformly supplied into a space between blades 224 by a distributor 226 that is disposed above a rotation shaft 222 of the charging rotor 220. The charging rotor 220 may rotate at a rate of about 300 rpm to about 5,000 rpm. The coal particles discharged to the upper portion of the charging rotor 220 may collide and be rubbed with the blades 224 and the rotation plate 225 and then be primarily charged with positive charges and negative charges by the rotation rate. The coal particles colliding with the blades of the charging rotor 220 and rotation plate 225 may be scattered to the surrounding and then be secondarily charged while colliding and being rubbed with the charging plate 212 surrounding the charging rotor. Here, the coal particles that are not charged by the charging rotor 220 may be charged while colliding with the charging plate 212 or other coal particles, and the coal particles charged by the charging rotor 220 may increase in charged degree while colliding or being rubbed with the charging plate 212 or other coal particles. Also, the coal particles may be repeatedly scattered and collide within the charging chamber 210 to increase in charging rate.

The coal particles charged in the charging unit 200 are discharged into the electrostatic sorting unit 300. The carbon particles charged with the negative charges move to a negative electrode plate 320*a*, and the sulfur and ash particles which are charged with negative charges move to a positive electrode plate 320*b* and then are sorted.

The coal particles sorted by the negative electrode plate 320*a* are put into the first storage part 410, and the sulfur and ash particles sorted by the positive electrode plate 320*b* are put into the second storage part 420. Here, a middling that is not charged in the charging unit 200 or the particles that are not sorted by the negative and positive electrode plates 320*a* and 320*b* may put into a third storage part 430 disposed between the first and second storage parts 410 and 420. The particles put into the third storage part 430 may be transferred again into the raw material storage unit 110 and then resorted through a resorting process.

As described above, while this invention has been particularly shown and described with reference to preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

INDUSTRIAL APPLICABILITY

According to the raw material sorting apparatus and the method therefore according to the embodiment of the present invention, the main component and impurities may be sorted by using a difference in electrostatic polarities of the components contained in the raw material to improve the purity of the raw material that is used in the sorting process. Therefore, the inexpensive and low quality raw material in which a large amount of impurities is contained may be utilized to reduce the manufacturing costs.

The invention claimed is:

1. A raw material sorting apparatus for sorting a raw material, the raw material sorting apparatus comprising:

a raw material supply unit configured to supply a raw material;

a charging unit configured to electrostatically charge the raw material supplied from the raw material supply unit, wherein the charging unit comprises: a charging chamber providing a space where the raw material is electrostatically charged; and a charging rotor rotatably provided inside the charging chamber to apply an impact to the raw material by a rotation force thereof, wherein the rotor comprises: a rotation shaft rotating by a driver; a distributor disposed on top of the rotation shaft; at least one blade disposed blow the distributor, the at least one blade extending radially from an outer circumferential surface of the rotation shaft and in parallel with a rotation axis of the rotation shaft; and a rotation plate disposed below the at least one blade, the rotation plate extending radially from the outer circumferential surface and in perpendicular to the at least one blade;

an electrostatic sorting unit configured to separate the charged raw material charged in the charging unit according to polarities of the charged raw material; and a sorting storage unit configured to collect the raw material that is sorted in the electrostatic sorting unit.

2. The raw material sorting apparatus of claim 1, wherein the charging chamber comprises:

a charging plate having an inclined surface, which is inclined toward a central axis of the charging chamber; and a heater configured to heat the charging chamber.

3. The raw material sorting apparatus of claim 1, wherein the distributor has a cone or polygonal pyramid shape.

4. The raw material sorting apparatus of claim 1, wherein the electrostatic sorting unit comprises:

a negative electrode plate that is vertically disposed; and a positive electrode plate vertically disposed to be spaced apart from the negative electrode plate, wherein each of the negative electrode plate and the positive electrode plate has a power portion that is inclined toward the outside.

5. The raw material sorting apparatus of claim 4, wherein at least one of a distance and angle between the negative electrode plate and the positive electrode plate is adjustable.

6. The raw material sorting apparatus of claim 1, wherein the electrostatic sorting unit comprises:

a pair of electrode members spaced apart from each other, the pair of electrode members being vertically disposed; and a rotation sheet surrounding each of the electrode members to vertically rotate, wherein the pair of electrode members have polarities different from each other.

7. The raw material sorting apparatus of claim 6, wherein a scraper configured to separate the charged raw material attached to the rotation sheet is disposed on one side of the rotation sheet.

8. The raw material sorting apparatus of claim 1, wherein the electrostatic sorting unit comprises:

a lower conveyor comprising a first belt that operates in a caterpillar manner and a first electrode body disposed in an inner region of the first belt; and an upper conveyor disposed above and spaced apart from the lower conveyor, the upper conveyor comprising a second belt that operates in the caterpillar manner and a second electrode body having a polarity different from that of the first electrode body and disposed in an inner region of the second belt.

9. The raw material sorting apparatus of claim 8, wherein, in the lower conveyor, the first belt is connected to a pair of lower driving shafts to operate in the caterpillar manner, the first electrode body is disposed between the pair of lower driving shafts, and a first deionizer is disposed at one side of the inner region of the first belt, and in the upper conveyor, the second belt is connected to a pair of upper driving shafts to operate in the caterpillar manner, the second electrode body is disposed between the pair of upper driving shafts, and a second deionizer is disposed at one side of the inner region of the second belt.

10. The raw material sorting apparatus of claim 9, wherein a scraper is disposed outside at least one of the first and second belts.

11. The raw material sorting apparatus of claim 10, wherein each of the first and second belts is formed of an electrically conductive material.

12. The raw material sorting apparatus of claim 11, wherein the upper conveyor comprises a tension shaft that lifts a return part of the second belt upward to maintain tension of the second belt.

13. The raw material sorting apparatus of claim 12, wherein the upper conveyor and the lower conveyor at least partially overlap each other, and surfaces of the upper conveyor and the lower conveyor, which face each other, are disposed in parallel to each other.

14. The raw material sorting apparatus of claim 13, wherein a rotation wall configured to separate the charged raw material into a main component and impurities and guide the main component and the impurities to opened upper ends of the first and second storage parts is disposed on an upper end of a partition wall, and the rotation wall is hinge-coupled to an upper end of the partition wall to rotate to an upper region of the first or second storage part.

* * * * *